United States Patent [19]

Schumacher

[11] 4,334,586

[45] Jun. 15, 1982

[54] INSERTS FOR DRILLING BITS

[75] Inventor: Percy W. Schumacher, Houston, Tex.

[73] Assignee: Reed Rock Bit Company, Houston, Tex.

[21] Appl. No.: 156,719

[22] Filed: Jun. 5, 1980

[51] Int. Cl.[3] ..... E21B 10/16; E21B 10/56

[52] U.S. Cl. ..... 175/374; 175/410

[58] Field of Search ..... 175/374, 410

[56] References Cited

U.S. PATENT DOCUMENTS 3,385,385 5/1968 Kucera et al. ..... 175/374
4,058,177 11/1977 Langford et al. ..... 175/374
4,086,973 5/1978 Keller et al. ..... 175/410 X
4,108,260 8/1978 Bozarth ..... 175/410 X

FOREIGN PATENT DOCUMENTS 2035261 1/1972 Fed. Rep. of Germany ..... 175/410

*Primary Examiner*—Ernest R. Purser
*Attorney, Agent, or Firm*—Carl Rowald

[57] ABSTRACT

Inserted hard metal cutting elements are disclosed which are advantageous for inserting into the cutters of drilling bits used in drilling underground formations. The inserted cutting elements comprise asymmetrical inserts placed in at least one row of a cutter in alternating alignment circumferentially therearound.

10 Claims, 11 Drawing Figures

INSERTS FOR DRILLING BITS

BACKGROUND OF THE INVENTION

The present invention is generally related to drilling bits and more particularly involves drill bits having hard metal cutting elements inserted therein, while cutting elements are commonly referred to as inserts and are usually manufactured from a sintered tungsten carbide material. In one embodiment of the invention, the inserts are utilized in a tri-cone rolling cutter drill bit of the type disclosed in U.S. Pat. No. 3,495,668. A similar tri-cone rolling cutter drill bit is disclosed in co-pending application Ser. No. 062,260, filed July 30, 1979, by Kenneth W. Jones for "Oil Well Drilling Bit". In this co-pending application, which is assigned to the assignee of the present application, a tri-cone rolling cutter drill bit is disclosed which utilizes a unique system of insert alignment in the intermediate and gage rows of the cutters.

As mentioned in the aforesaid Jones patent application, the tri-cone bit usually has three rolling cone cutters rotatably mounted on downwardly extending bearing journals at the lower end of the bit body. There are generally two types of rolling-cone cutters utilized in these types of bits: the milled tooth cutter and the insert cutter. The present invention relates to the insert type of bits wherein the cutter cones are made of one material such as a steel alloy, and the cutting elements are made of a harder metal such as a tungsten carbide in a cobalt matrix, and then are pressed into recesses which have been drilled in the cone surfaces. The insert bit offers the advantage of a hard metal cutting element or insert which is tremendously resistant to the abrasive forces normally incurred during drilling operations. Since the inserts are made of a hard material such as tungsten carbide which has been sintered and compacted into a generally cylindrical base portion having a frustoconical protruding portion, the inserts are generally more susceptible to breaking, but on the other hand will outlast a milled tooth cutter several times. The disadvantage of the insert type bits as opposed to the milled tooth bits is that the hard metal inserts are generally not as fracture-resistant as the milled tooth, and therefore cannot be shaped as broad and flat and sharp as the milled tooth. Thus, the bottom hole coverage and penetration rate of the hard metal insert is somewhat less than the milled tooth, although the insert will wear many times longer than the milled tooth.

The conventional insert bits manufactured today generally utilize three rolling cones having circumferential rows of inserts securely attached to the cones by means of interference fit within holes bored substantially perpendicular to the surface of the cone. These conventional cutter cones have rows of inserts placed in circumferential rows on the cone surface in raised shoulders, or lands. The conventional insert type construction suffers from an undesirable effect known as tracking and gyration.

Tracking and gyration occurs because of the circumferential rows of inserts which form grooves in the rock face being drilled. These parallel grooves leave a raised ridge of rock material called a kerf. When this kerf becomes high enough, it causes these rows of inserts to track down grooves cut by the other cutter inserts and results in a drill bit following a noncentral axis of rotation. Thus, the tracking of cutter inserts in the rows formed by adjacent cutters causes a gyration of the bit off the center of rotation of the bit. This orbital gyration is a destructive force on the drill bit, placing high stress on the bearings and cutting structures both. Furthermore, the gyration effect reduces the cutting speed of the bit to a negligible amount, and the resulting kerf buildup eventually contacts the non-cutting surfaces of the cone and almost stops the cutting action of the bit in the formation. The gyration forces introduced during tracking and the orbital motion described above are not those for which the bit is designed, and as a result, unusual and rapid damage occurs to the inserts, the cones and the bearings.

The present invention overcomes these disadvantages by providing a drill bit structure having a unique insert design which reduces failures of the cone structure and greatly reduces gyration and tracking of the conical cutters of the drill bit. The pattern of insert crests on the cutters is a series of sinusoidal circumferential bands in the gage and intermediate rows of the cutter cone surfaces. The aforementioned co-pending application of Kenneth W. Jones discloses a non-linear circumferential row of inserts which is formed by drilling non-linear rows of insert holes in the intermediate and gage row lands. The inserts utilized are symmetrical inserts which are placed in a non-linear pattern on the cutters. While the Jones concept is a significant improvement over the conventional linear rows of inserts, the present invention provides further improvement over the aforesaid Jones method. The present invention utilizes non-symmetrical inserts which are placed in linear rows of insert holes, but which result in non-linear insert projections and increased bottom hole coverage, reduced tracking and gyration, and no sacrifice in rate of penetration.

DESCRIPTION OF THE PREFERRED EMBODIMENTS

Figure 1:
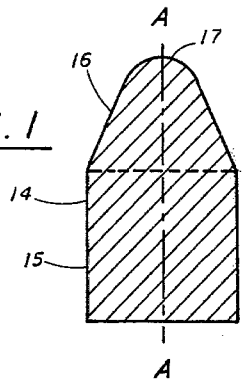
FIG. 1 is a side elevation view of an insert formed according to the present invention.
Figure 2:
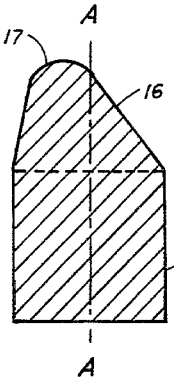
FIG. 2 is a front elevational view of the insert of FIG. 1 taken at a 90-degree angle thereto.
Figure 3:
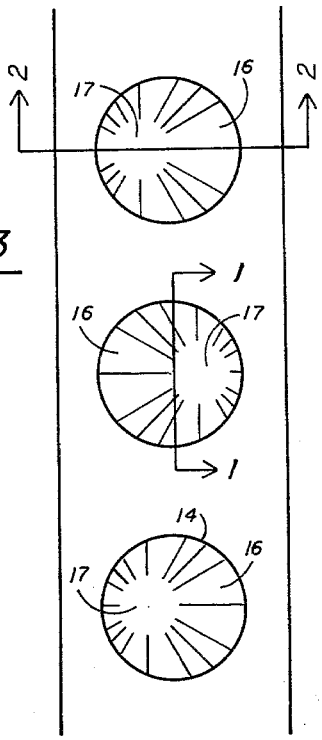
FIG. 3 is a top view of a row of inserts formed according to the present invention.

The present invention as disclosed in FIGS. 1 through 11 discloses a tri-cone, rolling cutter drill bit which is utilized to bore holes through underground formations. The tri-cone, rolling cutter drill bit is of the type disclosed in U.S. Pat. No. 3,495,668 by P. W. Schumacher, Jr., filed July 5, 1968, and issued Feb. 17, 1970, entitled, "Drill Bit"; which patent is hereby incorporated by reference. In the aforementioned Schumacher patent, a drill bit body 12 is provided which has a threaded pin 14 and three downwardly extending lugs 18. A set of frustoconical cutters 16 are rotatably mounted on lugs 18. Each frustoconical cutter 16 has several rows of inserted hard metal cutting elements thereon, which cutting elements protrude from the surface of the frustoconical cutters and provide the cutting action against the borehole face. The circumferential rows of cutting elements or inserts are clearly disclosed in FIG. 2 of the Schumacher patent and designated in FIG. 3 by the numbers 1, 2 and 3, which numbers 1, 2 and 3 represent the cone numbers in which the individual inserts are located. FIG. 3 of Schumacher contains at the lower end thereof what is commonly termed a cutter profile, or insert profile, showing the relationships between the inserts on the three cutters as related to their coverage of the bottom hole.

Figure 4:
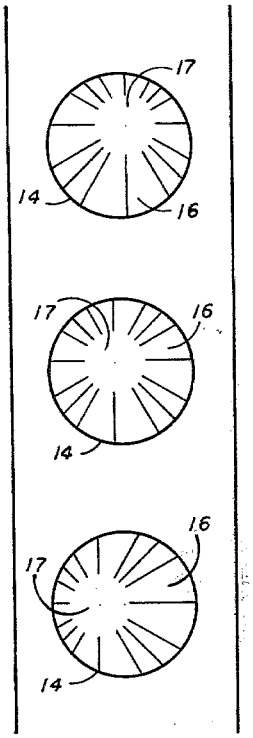
FIG. 4 is a top view of a row of inserts in a different arrangement from that of FIG. 3.
Figure 5:
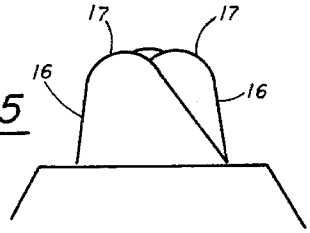
FIG. 5 is a front projection of the row of inserts disclosed in FIG. 3.

In the present invention the circumferential rows of inserts, as illustrated in FIGS. 3, 4, 6 and 9, utilize the general circumferential lands 10, 11, 12 and 13 very similarly to those lands utilized in the Schumacher invention. In FIG. 3 land 10 contains a plurality of hard metal cutting elements 14 arranged in recesses cut substantially perpendicularly into the cutter cone material. The base portions of the inserts 14, as better illustrated in FIGS. 1 and 2, comprise generally cylindrical sections 15. The protruding portions of inserts 14 comprise non-symmetrical generally conical sections 16 having rounded or blunted ends 17. The embodiment shown in FIGS. 1 through 5 utilize inserts which have been offset in the protruding portion only and the protruding portion still maintains the basic advantages of the conical insert. The conical insert, as mentioned in the aforesaid Schumacher patent, is advantageous in that it provides maximum strength with optimum rates of penetration and good bottom hole coverage. By utilizing the offset conical as disclosed herein, additional bottom hole coverage and reduced gyration can be achieved without sacrificing the fine advantages of the conical design. FIG. 1 illustrates a side view of the insert 14 in which the projection or profile of the insert is symmetrical about the central axis A—A of the insert. FIG. 2, which is a side view of the insert 14 taken at 90 degrees from FIG. 1, shows the non-symmetrical configuration of the protruding conical portion 16. In FIG. 2, it can be seen that the crown or blunted end 17 of the protruding section 16 is located almost entirely to the left of the central axis A—A. In the embodiment of FIG. 3, a gage row or intermediate row of inserts is located on the frustoconical cutter shell such that the inserts are oriented in alternating placements with the offset staggered left and right down the row. In other words, the offset as shown in FIG. 2 will be in every other insert and the offset will be rotated 180 degrees in the inserts located between these inserts. FIG. 5 illustrates an end view of a row of inserts oriented according to FIG. 3. It can be seen from FIG. 5 that this orientation results in the same effect as if a broad chisel-type insert had been utilized in the rows. This desirable effect is achieved without incurring any of the undesirable effects of utilizing the broad, flat chisel insert, i.e., increased breakage and reduced rate of penetration. In FIG. 4, a less drastic alternating pattern is disclosed wherein the offset is moved in increments of 45 degrees, rather than the 180-degree increments disclosed in FIG. 5. A third embodiment, of course, would utilize increments in the offset of 90 degrees, which would lie between the embodiments of FIGS. 3 and 4.

Figure 6:
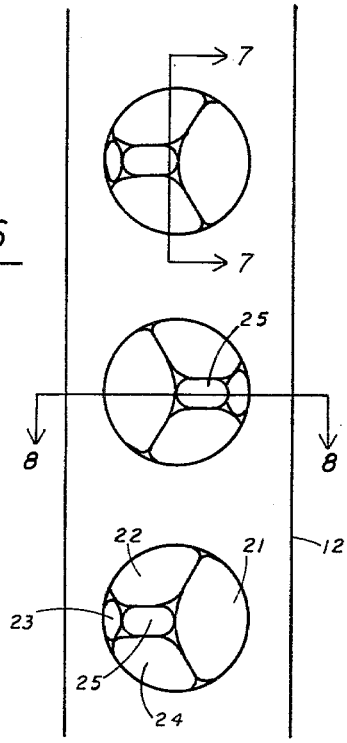
FIG. 6 is a top view of a row of inserts formed according to a second embodiment of the invention.
Figure 7:
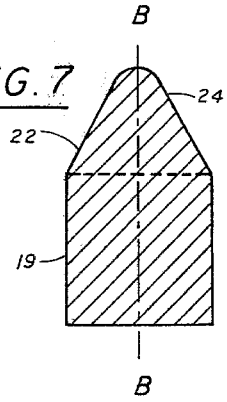
FIG. 7 is a side view of the inserts disclosed in FIG. 6.
Figure 8:
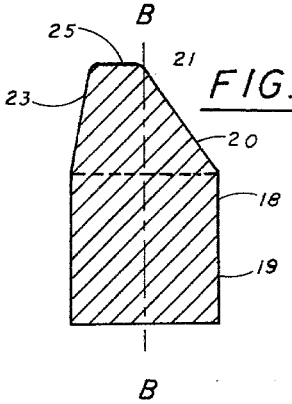
FIG. 8 is a front elevational view of the inserts of FIGS. 6 and 7.

Referring now to FIGS. 6 through 8, another embodiment of the invention is disclosed in which a generally sharp, narrow chisel insert 18 is disclosed having the same cylindrical base section 19, a protruding portion 20 and a central axis B-B. The protruding portion 20 comprises basically a pyramidal configuration having relatively flat opposing sides 21, 22, 23 and 24, with a short, rounded, rooftop end 25. FIG. 7 is a cross-sectional view of insert 18 taken at line 7—7 of FIG. 6. FIG. 8 is a cross-sectional view of insert 18 taken at line 8—8 of FIG. 6. The non-symmetrical, narrow chisel shape has a flat, narrow chisel with a longitudinal length normal to the direction of the land 12. In FIG. 6, the offset of the sharp chisel point 25 is alternated between left and right orientations in a 180-degree incremental pattern. Thus, a projection of the row of inserts of FIG. 6, which would be an end view thereof similar to that of FIG. 5, would show that because of the offset nature of the protruding portion of the inserts, a substantial increase in bottom hole coverage is obtained without sacrificing strength or penetration in the individual inserts. Furthermore, the nonlinear pattern of the individual inserts within any one row greatly reduces the effects of tracking and gyration found in conventional bits.

Figure 9:
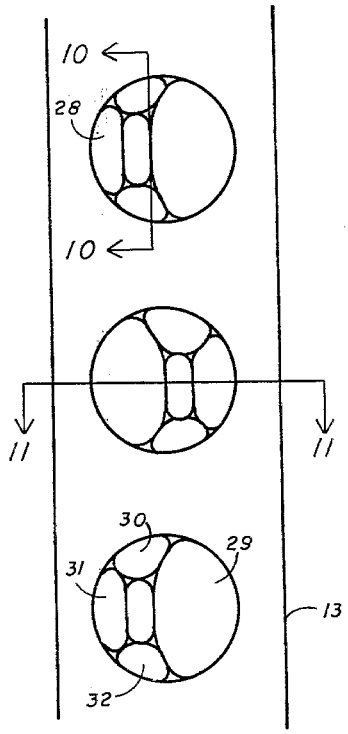
FIG. 9 is a third embodiment of the invention in which a row of inserts is disclosed in a top view.
Figure 10:
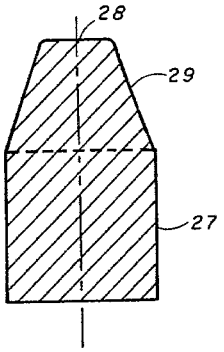
FIG. 10 is a side view of the inserts of FIG. 9.
Figure 11:
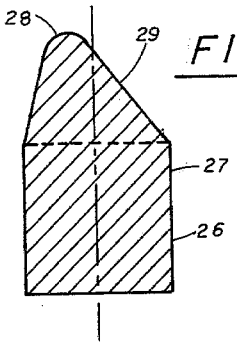
FIG. 11 is a front view of the inserts of FIG. 9.

Referring now to FIGS. 9 through 11, another embodiment of the invention is disclosed in which a relatively sharp, offset chisel insert is illustrated. The insert of this embodiment is denoted at 26 and features a generally cylindrical base portion 27, which is adapted to be inserted into a hole in a cutter cone with a tight or intereference fit. Insert 26 has a nonsymmetrical protruding portion 27 and a rounded, extended crest 28. The protruding section 27 comprises a set of relatively flat, opposed sides 29, 30, 31 and 32. FIG. 10 is a cross-sectional view of the insert taken at line 10—10 of FIG. 9. FIG. 11 is a cross-sectional view of the insert 26 taken at line 11—11 of FIG. 9. The insert of this embodiment is similar to that of the previous embodiment except for the fact that the elongated, rounded, chisel crest 28 is oriented on the insert 90 degrees from that of the previous insert. In this embodiment, the elongation of chisel crest 28 runs parallel to the orientation of land 13, rather than normal to the land as shown in FIG. 6. The resulting drill bit utilizing inserts of FIG. 9 over those of FIG. 6 would provide slightly less bottom hole coverage, but would add increased resistance to breakage in the direction parallel to the land 13, i.e., the circumferential direction around the drill bit cutter and would further reduce tracking. The inserts of this embodiment furthermore would provide the reduced gyration as featured in the previous embodiments.

SUMMARY OF THE INVENTION

The present invention is directed to a tri-cone drill bit which utilizes intermediate and gage rows of inserts placed in circumferentially aligned recesses in the cutter cones, but having non-symmetrical offset protrusions to increase bottom hole coverage, reduce gyration and maintain optimum insert strength. The drilling of the recesses for the inserts in the present invention is simplified by retaining them in a circumferential alignment on the cutter. This is opposed to the sinusoidal arrangement found in the aforementioned Jones application which, although providing increased bottom hole coverage, requires more difficult machine work in the forming of the insert recesses in the cutters.

Although certain preferred embodiments of the invention have been herein described in order to provide an understanding of the general principles of the invention, it will be appreciated that various changes and modifications can be effected in the described drilling bit without departing from these principles. For example, whereas conical and pyramidal inserts are illustrated, it is clear that non-symmetrical configurations of other shapes could be utilized, such as elliptic, parabolic, ogive, and combinations of these with conical and/or pyramidal. Also, inserts utilizing the curved profiles, such as the conical, ogive, parabolic, etc., could be sharpened or slabbed off on any one or more sides to arrive at other insert configurations which still embody the present invention. The invention therefore is declared to cover all changes and modifications of the specific examples of the invention herein disclosed for purposes of illustration which do not constitute departures from the spirit and scope of the invention.

I claim:

1. In a rolling cutter drill bit of the type having a central body, an upper threaded pin end, a plurality of downwardly extending legs on said body, each said leg having a bearing journal protruding therefrom, and a generally frusto-conical cutter rotatably mounted on each said bearing journal, at least one of said cutters having a gage row and at least one nongage row of hard metal cutting elements inserted therein and protruding therefrom, the improvement comprising:

a majority of said cutting elements in at least one of said rows comprises asymmetrical elements having a generally cylindrical base portion and an asymmetrical protruding portion; and, wherein said asymmetrical portions of at least two of said elements in said one row are arranged at different angular orientations in relation to a circumference of said cutter.

2. The rolling cutter drill bit of claim 1 wherein said legs are three in number and said cutters each have a gage row and at least one non-gage row of inserted hard metal cutting elements, and wherein at least one of said rows on each said cutter comprises inserts, at least half of which have asymmetrical protruding portions arranged in angularly displaced staggered relationship with respect to a circumference of said cutters.

3. The rolling cutter drill bit of claim 1 or claim 2 wherein the angular displacement of the asymmetrical portion of said adjacent inserts ranges between 15 degrees and 180 degrees with respect to the circumference of said cutter.

4. The rolling cutter drill bit of claim 1 or claim 2 wherein the protruding portions of said asymmetrical inserts each comprises a generally frusto-conical section with a rounded end.

5. The rolling cutter drill bit of claim 1 or claim 2 wherein said asymmetrical protruding portion comprises a generally pyramidal section with a rounded elongated top.

6. A rolling cutter drill bit of the type having a body, three downwardly projecting legs attached to said body and having inwardly projecting bearing journals thereon, a generally conical cutter rotatably mounted on each of said journals by bearing means, and inserted hard metal cutting elements arranged in substantially circumferential rows on said cutters, the improvement comprising: said cutting elements in at least one of said rows on each said cutter having asymmetrical protruding portions which are arranged in alternating angular displacements with respect to the circumference of said cutters.

7. The rolling cutter drill bit of claim 6 wherein said cutters each have asymmetrically shaped hard metal inserts in staggered arrangement in at least one nongage row.

8. In a cutter of the type used for penetrating underground formations wherein said cutter has a generally frusto-conical body rotatably mounted on a shaft, and protruding hard metal cutting elements inserted thereon arranged in generally circumferential rows, the improvement comprising:

at least two of said inserts in at least one of said rows each having a generally cylindrical base portion and an asymmetrical protruding portion, the protruding portions of said inserts having angular orientations different from each other in said row.

9. A hard metal insert for use as a cutting element in rock cutting and drilling apparatus said insert comprising:

a generally cylindrical base section having a central longitudinal axis; and, a frusto-conical protruding section having a rounded top end, said protruding section consisting of a non-right-circular cone having a central axis non-aligned with the central axis of said base section, and said top end being radially displaced from said base section central axis.

10. A hard metal insert for use as a cutting element in rock cutting and drilling apparatus, said insert comprising:

a generally cylindrical base portion having a central longitudinal axis; and, a non-regular pyramidal protruding section having an elongated rounded crest, said protruding section having a central axis non-aligned with respect to said base portion central axis, and a top portion radially displaced from said base portion central axis.

* * * * *